United States Patent [19]

Plunkett et al.

[11] 4,246,747

[45] Jan. 27, 1981

[54] HEAT BULKABLE POLYESTER YARN AND METHOD OF FORMING SAME

[75] Inventors: Joseph A. Plunkett; James R. Talbot, both of Charlotte, N.C.

[73] Assignee: Fiber Industries, Inc., Charlotte, N.C.

[21] Appl. No.: 219

[22] Filed: Jan. 2, 1979

[51] Int. Cl.[3] ..... D02G 1/18; D01D 5/084; D01D 5/088

[52] U.S. Cl. ..... 57/245; 57/246; 57/2.82; 57/309; 264/210.8; 264/234

[58] Field of Search ..... 57/243, 244, 245, 246, 57/282, 283, 290, 300, 309, 351, 905, 908; 264/210.8, 103, 176 F, 234; 28/247; 428/369

[56] References Cited

U.S. PATENT DOCUMENTS

| | | | |
|---|---|---|---|
| 2,604,689 | 7/1952 | Hebeler | 264/234 X |
| 3,705,225 | 12/1972 | Taylor | 264/210.8 X |
| 3,946,100 | 3/1976 | Davis et al. | 264/234 X |
| 4,000,238 | 12/1976 | Maurer | 264/234 X |

*Primary Examiner*—Donald Watkins

*Attorney, Agent, or Firm*—Herbert M. Adrian, Jr.

[57] ABSTRACT

The present invention relates to a process and product for directly producing a latent heat-bulkable yarn from the same polymer composition in the same spinning process. The self-crimping yarn is produced from polyethylene terephthalate compositions which are melt spun at high speeds to form a plurality of spin oriented filaments. The filaments are divided in the spinning column into at least two groups and the two groups of filaments are subjected to different heat conditions, recombined, and taken up as a fully drawn yarn. The high spinning speed and differential heat treatment are selected to produce highly spin oriented yarn of relatively high spun birefringence with the conditions of spinning speed and heat treatment being controlled to produce a desired shrinkage differential between the two groups of filaments of up to 60 percent. The yarn is self-crimped by subsequent heat treatment to effect shrinkage, preferably after being formed into fabric, such as occurs in the hot dyeing and/or scouring of the fabric.

15 Claims, 3 Drawing Figures

HEAT BULKABLE POLYESTER YARN AND METHOD OF FORMING SAME

BACKGROUND OF THE INVENTION

Latent bulkable yarns have previously been disclosed in the art. Such yarns have generally fallen into one of two classifications, i.e., (1) different polymer materials or (2) different drawing and relaxing conditions, such that when two yarns are combined, they have different shrinkage or elongation properties. Numerous variations in the above basic processes are known to provide different combinations of process steps and/or resulting properties.

The primary deficiency with the previous processes have been that the polymers had to be different, thus requiring separate spinning processes or complex heterofilament spinning systems or the yarns had to be separately drawn and/or relaxed prior to combining so as to achieve the desired differentiation of shrinkage and/or elongation properties. The present process uses the same polymer in a single spinning operation without a separate drawing step. Not only is the same polymer used, it is spun from the same spinneret, thus additionally eliminating separately spinning a second polymer and combining differently spun fibers into a singles yarn.

It is therefore an object of the present invention to produce a latent heat bulkable yarn from the same polymer spun from the same spinneret and spinning column.

It is another object of the present invention to provide a latent heat-bulkable yarn without the requirement of a drawing step.

It is yet another object of the present invention to produce a latent heat bulkable yarn in which the individual fibers have a difference in shrinkage of up to 60 percent, thereby enabling the production of substantial bulk in the resulting yarn.

These and other objects will become apparent from the description of the process and product which follows.

THE INVENTION

In accordance with the invention, a latent heat-bulkable polyethylene terephthalate yarn is provided comprising melt spinning a polyethylene terephthalate fiber-forming polymer into a plurality of filaments, cooling the melt spun filaments in a spinning column to below their second order transition temperature, dividing the filaments into at least two groups in the spinning column, subjecting at least one of said groups of filaments to a heat treatment at a temperature above the second order transition temperature, recombining the filaments into a yarn, and taking up the yarn at a speed in excess of 8000 feet per minute.

The yarn of the present invention is produced by a high speed melt spin-orientation process which is particularly adapted to textile filament yarns wherein two or more groups of filaments from the same spinneret are subjected to differential thermal treatments of the filaments prior to take-up. The threadline is split in the spinning column and treated so that part of the filaments have a relatively high boiling water shrinkage and the remainder of the filaments have a relatively low shrinkage. The groups of filaments are recombined, preferably intermingled, and wound onto a package at high speed. The high speed spinning operation produces orientation in the yarn such that the filaments are of sufficiently high birefringence and orientation so as not to require a separate or subsequent drawing step for most textile end useages.

When the yarn of the present invention is exposed to yarn heat shrinking temperatures of about 100 degrees centigrade such as occurs in a dyebath, the high shrinkage filaments reduce in length, i.e., shrink while the low shrinkage filaments remain substantially unchanged. This shrinkage produces a yarn bundle with a group of filaments forming a substantially straight-core portion surrounded by the remaining filaments which form loopy effect filaments. This effect is manifest as a type of bulk in fabrics to produce a silk-like hand which is distinct from flat yarns and not as bulky or crimpled as textured yarns. The bulk, however, is not apparent in the yarn itself until after the heat-shrinking treatment. Thus, the yarns can be formed into fabric by subjection of the fabric to normal dyeing and finishing. The latent bulkable yarns of the present invention thus have an added advantage in the formation of fabric because it is generally easier to knit or weave flat yarns than bulked yarns.

Unlike otner latent bulk processes, the present invention is extremely flexible, being capable of producing yarn shrinkage differentials ranging up to about 60 percent. With such a wide shrinkage differential capability, bulk development can be controlled to provide novel aesthetics ranging from those obtained with flat yarns up to those obtained with textured yarns. Generally the bulk is less than high bulk false twist textured yarns.

DETAILS OF THE INVENTION

The invention will be more particularly described by reference to the drawings wherein.

The process of the present invention is capable of operation under three separate variations. These variations can be identified as:

(A) a temperature controlled shrinkage method;

(B) a speed controlled shrinkage method; and (C) a high speed crystallinity modification method.

The present invention is directed to polyester polymers, more particularly described as polyethylene terephthalate, which are melt spinnable and preferably have an intrinsic viscosity (I.V. in the range of about 0.35 to 1.0 and more preferably in the range of about 0.55 to 0.80. The I.V. is determined by the equation $$\lim_{C \to 0} \frac{\ln nr}{C}$$

wherein nr is the "relative viscosity". Relative viscosity is determined by dividing the viscosity of an 8 percent solution of polymer in orthochlorophenol solvent by the viscosity of the solvent as measured at 25 degrees centigrade. The polymer concentration of the noted formula is expressed as C in grams per 100 milliliters.

The fiber-forming polyester polymers, when spun into fibers, commonly exhibit a glass transition temperature of about 75 to 80 degrees centigrade and a melting point of about 250 degrees to 265 degrees centigrade, the exact temperature of which are dependent on polymer modifications, degree of orientation and other factors known to those skilled in the art.

The polyesters of the present invention consist essentially of synthetic linear polyethylene terephthalate polymer which may contain various modifiers such as materials conventionally used in polyester yarns including chemical and physical modifiers which effect the chemical and physical properties of the fiber. Copolymers of polyethylene terephthalate with various reactive monomers can be used such as cationic dyeable polymer modifiers and/or other reactive modifiers such as isophthalic acid, 5-sulfoisophthalic acid, propylene glycol, butylene glycol, and the like copolymerizable monomers. Polymer meeting the specified requirements of the present process may additionally or alternatively contain minor amounts of materials used in conventional yarns such as dyesite modifiers, delustrants, optical brightners, polymer modifiers, and the like, in amounts of up to 20 percent of the polymer weight but most preferably not more than about 5 percent by weight.

Figure 1:
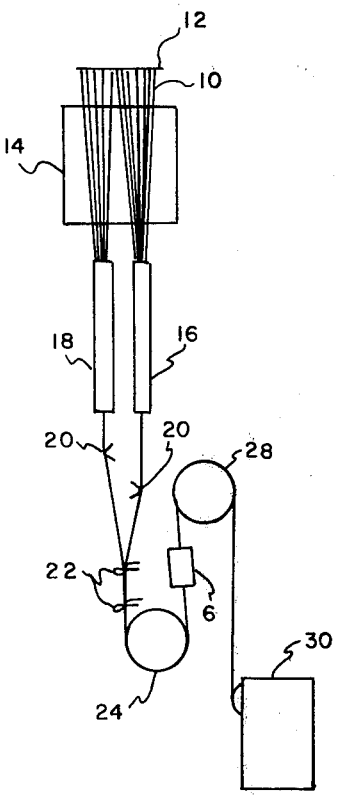
FIG. 1 is a partial schematic illustrating a spinning arrangement for one aspect of the present invention.

Referring more particularly to FIG. 1, polyethylene terephthalate fibers are melt spun from spinneret 12 as a plurality of filaments and passed through a quench zone 14 wherein the freshly spun filaments are cooled to below the glass transition temperature. The filaments 10 are separated into at least two groups and passed through heating means 16 and 18. Heating means 16 and 18 are preferably hot air tubes in which the temperatures can be adjusted to heat the individual groups of filaments to the desired temperatures. The filaments then pass across finish applicators 20 which can additionally serve as the guide means for separating the filaments into the groups while in the spinning column. The treated filaments then pass through converging guides 22, hence to godet 24, preferably through intermingler 26, godet 28 and take-up 30.

In temperature control shrinkage method (A), the take-up speed is controlled at a speed equal to or greater than 9,000 feet per minute while hot air tube 16 is controlled at a temperature of above the second order transition, i.e., about 80 degrees centigrade up to about 150 degrees centigrade with heater means 18 being controlled at a temperature at least 40 degrees centigrade higher than heating means 16 up to about 230 degrees centigrade.

As has been pointed out by Davis et al in U.S. Pat. No. 3,946,100, fully drawn yarn of high crystalline orientation is produced by high stress spinning such as occurs at the indicated speeds above about 12,000 feet per minute coupled with a heat treatment during the high stress spinning after the quenching of the filaments. Yarns produced by this heat treatment are fully oriented and have shrinkage lower than 10 percent and, depending on the heat treatment, as low as about 2 percent. Such treated filaments have lower shrinkages than can be obtained by conventional spinning-drawing methods and the filaments have a different crystalline morphology. The filaments passing through heater means 16 are subjected to a lesser amount of heat and therefore retain a higher degree of shrinkage in the range of 10 to 60 percent boiling water shrinkage with the higher shrinkage being retained at the lower heat treatment temperatures. Filaments passing through heater means 18 and subjected to temperatures in the range of about 175 to 230 degrees centigrade will posess the lower shrinkage, less than 10 percent, with higher treatment temperatures producing lower shrinkages.

In the described process, it has been found that hot air tubes are preferred since they do not produce additional drag on the filaments which can be critical to the desired orientation and crystallinity being effected at the high speeds. It has further been found that hot air tubes should be of sufficient length to heat the yarns to the desired temperature. This temperature is, of course, dependent on denier and residence time which in turn is dependent on spinning speeds. With the present invention, various lengths of heat tubes can be used but as a practical matter, it is preferred to have a heat tube of about 4 feet in length as this length tends to impose on the filaments the tube temperature in the indicated speed ranges of 8000 up to 20,000 feet per minute. At the lower speeds or higher heat treatment temperatures, shorter tube lengths can be used, but in order to have a tube which is best suited for high speeds and/or low heat treatment temperatures the indicated length is preferred.

Figure 2:
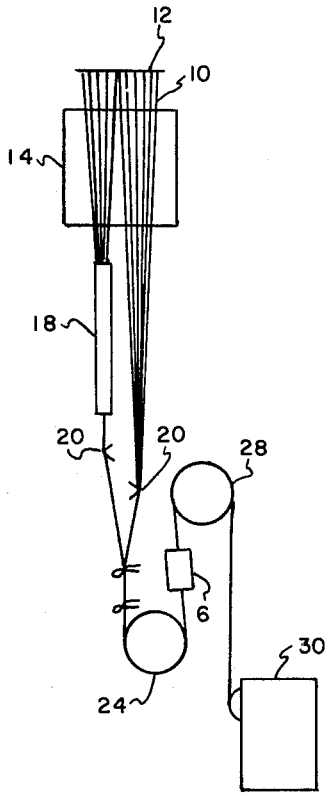
FIG. 2 is a partial schematic illustrating another spinning arrangement for the process of the present invention.

Referring more particularly to FIG. 2, speed control shrinkage method (B) is effected by the utilization of only one heat means, i.e., heat means 18. The process of this invention is speed controlled in the range of 8500 to 12,000 feet per minute. By increasing the spinning speed, the orientation and birefringence of the untreated group of filaments is changed with higher speeds resulting in higher spin orientation, higher birefringence and lower boiling water shrinkage. The group of filaments being passed through heat means 18 are treated at a temperature of about 175 to about 230 degrees centigrade to thereby effect crystallization and orientation and produce a fully drawn yarn having a high birefringence and a low boiling water shrinkage, i.e., less than 10 percent. As spinning speeds are increased, the boiling water shrinkage of the heat treated filaments is reduced to as low as about 2 percent at the highest spinning speeds. By this method, it is readily seen that a substantial differential between the two groups of filaments is obtained.

Referring again to FIG. 2, the high speed crystalline orientation method (C) can also be described. In this method, take-up speeds are in excess of 12,000 feet per minute and preferably in the range of 13,000 to 20,000 feet per minute. The filaments which bypass heat means 18 produce highly oriented low shrinkage fibers have a boiling water shrinkage of less than 10 percent. Filaments passing through heat means 18 are heat treated at a temperature between just above the glass transition temperature up to about 150 degrees centigrade, i.e., about 80 degrees centigrade to about 150 degrees centigrade, thereby producing higher boiling water shrinkage fibers which have shrinkages in the range of 10 to 60 percent boiling water shrinkage. The higher heat treatment temperatures produce the lower boiling water shrinkages.

Throughout the specification, reference has been made to high birefringence by which it is meant a birefringence in the yarn of at least 0.020 up to 0.100 or higher, which represents fully drawn yarn. More preferably, high birefringence means yarns having birefringence above about 0.040.

Birefringence is measured by the retardation technique described in *Fibers From Synthetic Polymers* by R. Hill (Elsevier Publishing Company, New York 1953), pages 266–8, using a polarizing microscope with rotatable stage together with a Berek compensator or cap analyzer and quartz wedge. The birefringence is calculated by dividing the measured retardation by the measured thickness of the fiber, expressed in the same units as the retardation. For samples in which the retardation technique is difficult to apply because of nonround fiber cross-section, presence of a dye in the fiber or the like, an alternative birefringence determination such as the Becke line method described by Hill may be employed.

The term "shrinkage" as used herein refers to boiling water shrinkage as measured by standard ASTM methods. Such methods generally involve the subjection of a skein of yarn of specified measured length to boiling water for a set period of time followed by a remeasurement of the yarn after boiling water treatment. Instruments such as the Texturemat are available to conduct such shrinkage tests and to additionally determine crimp contraction.

Since it is apparent from the description set forth herein that a number of different parameters can be adjusted to produce the differential shrinkage in the yarns to achieve up to about a 60 percent shrinkage differential, it is also apparent that a minimum differential shrinkage is needed to produce latent bulk. Depending upon the particular ascetics desired, a minimum differential of at least 5 percent is normally required to readily distinguish the present yarn from flat yarn in the resulting fabric. More preferably, the differential shrinkage should be at least 10 percent. Greater differential shrinkages produce correspondingly greater bulk but are not always necessarily more desirable. Certain particular desirable aesthetics are often obtained with the lesser shrinkage differentials.

The invention will be more specifically described by reference to the following examples which set forth certain preferred embodiments of the invention and are not intended to be limiting of the invention. Unless otherwise indicated, all temperatures are in degrees centigrade and all parts are by weight.

EXAMPLES 1-4

Process A of the present invention was operated in accordance with FIG. 1 at a constant speed with differential heat treatment at a wind-up speed of 12,000 feet per minute. Polyethylene terephthalate having an intrinsic viscosity of 0.655 was melt-spun at 305 degrees centigrade using a 36 hole spinneret designed for spinning 70 denier filament yarn. The molten filaments were directed downwardly into a spinning column and cooled by passing them through a cross flow quench zone. As the filaments passed the quench zone, they were divided into two groups of 18 filaments each prior to reaching a pair of hot air tubes.

The hot air tubes were positioned approximately 4 feet from the spinneret face and measured $\frac{5}{8}$ inch inside diameter by 4 feet in length. The first hot air tube was set to deliver a hot air temperature of 210 degrees centigrade. The second hot air tube was positioned the same distance from the spinneret parallel to the first tube with a different hot air temperature being applied as set forth in the table below. The filaments exiting from the hot air tubes had a spin finish applied thereto and then converged back to a singles yarn prior to reaching a first godet at the bottom of the spinning column. The converged yarn was then passed through an interlacing jet, positioned prior to a second godet, to provide yarn integrity prior to being taken up on a package at a speed of 12,000 feet per minute. A number of yarns produced in this manner with different second heater tube temperatures were bulked by subjecting skeins of yarn to a Texturemat test, which provided latent bulk development measurements and skein shrinkages with the following results:

TABLE I

| Yarn Ex. | 1st Hot Air Tube Temp. °C. | 2nd Hot Air Tube Temp. °C. | Hot Air Linear Shrinkage % | Hot Water Skein Shrinkage % | Crimp Contraction* % |
|---|---|---|---|---|---|
| 1 | 210 | 80 | 63.3 | 56.0 | 1.93 |
| 2 | 210 | 110 | 40.5 | N.R. | 4.6 |
| 3 | 210 | 140 | 66.8 | N.R. | 1.6 |
| 4 | 210 | 170 | 25.7 | N.R. | 4.4 |

N.R. = not run
*Texturemat results at 205° C.

The filaments passing through the first hot air tube resulted in filaments of fully drawn characteristics with a residual shrinkage of about 4 percent and about 38.5 percent elongation to break. Filaments passing through the second heater were partially oriented with a residual draw ratio of 1.1 to 1.5, depending on the tube temperature, and having a shrinkage as measured as linear shrinkage noted above. The differential shrinkage produced crimp and bulk commensurate with the noted yarn linear and skein shrinkage.

The advantage of the A process is the high speeds at which it can be run, i.e., 12,000 feet per minute or better with the disadvantage of requiring two hot air tubes regulated at different temperatures. This latter requirement needs careful control because of the step shrinkage versus temperature curve.

EXAMPLES 5 AND 6

Process B of the present invention is operated in accordance with FIG. 2 at spinning speeds in the range of 8,000 to 12,000 feet per minute. The process heat treats part of the filaments to produce fully drawn yarn having a boiling water shrinkage of 6 percent or less whereas the remainder of the filaments are left untreated. The untreated filaments are partially oriented, the orientation depending upon the wind-up speed with faster wind-up speeds resulting in higher orientation. The higher the orientation, the lower the shrinkage. The untreated filaments will have higher shrinkage than the heat treated filaments. Depending on the wind-up speed, overall skein shrinkages ranging from 5 to 60 percent can be produced. Using speed to control the shrinkage produces a very flexible process from which one can select both the overall skein shrinkage as well as the percentage of filaments which produce the bulk. However, the process' productivity is limited to appropriate wind-up speeds dictated by the desired shrinkage product.

In accordance with FIG. 2, polyethylene terephthalate having an intrinsic viscosity of 0.661 was melt spun at 290 degrees centigrade using a 20 hole spinneret to produce 43 denier, 20 filament yarn. The molten filaments were directed downwardly into a spinning column and cooled by passing them through a cross-flow quench zone. As the filaments pass through the quench zone, they were divided into two groups of 10 filaments each prior to reaching a hot air tube.

A single hot air tube was positioned approximately 4 feet from the spinneret face and measured $\frac{5}{8}$ inch inside diameter by 4 feet in length. One group of the filaments passed through the hot air tube and the other filaments continued downwardly through the spinning column without treatment. The hot air tube was set at 200 degrees centigrade with a positive hot air flow. The filaments exiting from the hot air tube and the untreated filaments had a spin finish applied thereto prior to converging the filaments into a singles yarn before reaching a first godet at the bottom of the spinning column. The converged yarn was then passed through an interlacing jet positioned prior to a second godet to provide yarn integrity prior to being taken up on a package at the speed indicated in Table II below. A number of yarns produced in this manner with different wind-up speeds were bulked by subjecting skeins of yarn to Texturemat test which provided latent bulk development measurements and skein shrinkages with the following results:

TABLE II

| Example Number | Wind-up Speed ft/min | Tenacity gms/den | Elongation % | Skein Shrinkage % |
|---|---|---|---|---|
| 5 | 10,500 | 2.97 | 50.8 | 7.7–12.0 |
| 6 | 8,300 | 2.34 | 56.4 | 28.1–35.5 |

It will be seen from the above examples that the amount of bulk development can be controlled by controlling the wind-up speed and, alternatively, by the hot air tube temperature treatment. The slower wind-up speeds in the B process produce greater bulk than the faster wind-up speeds.

Fabrics were produced using the yarns of Examples 5 and 6 prior to subjecting them to bulk development. Jersey and Delaware knitting stitches were used to form these fabrics. The fabrics were than preheated on a Bruckner tenter frame at a maximum temperature of 360 degrees Fahrenheit. Fabrics from Example 5 were permitted to shrink 10 percent by using a 10 percent linear overfeed and a width contraction from 68 inches to 60 inches. Fabrics from Example 6 were permitted to shrink 35 percent by using a 35 percent linear overfeed and a width contraction from 68 inches to 54 inches. After preheatsetting, the fabrics were pressure beck dyed and then heatset at 360 degrees Fahrenheit. The resulting fabrics had a very soft hand with silk-like aesthetics and sheen. The measured fabric bulk was proportional to the skein shrinkage.

EXAMPLE 7

Figure 3:
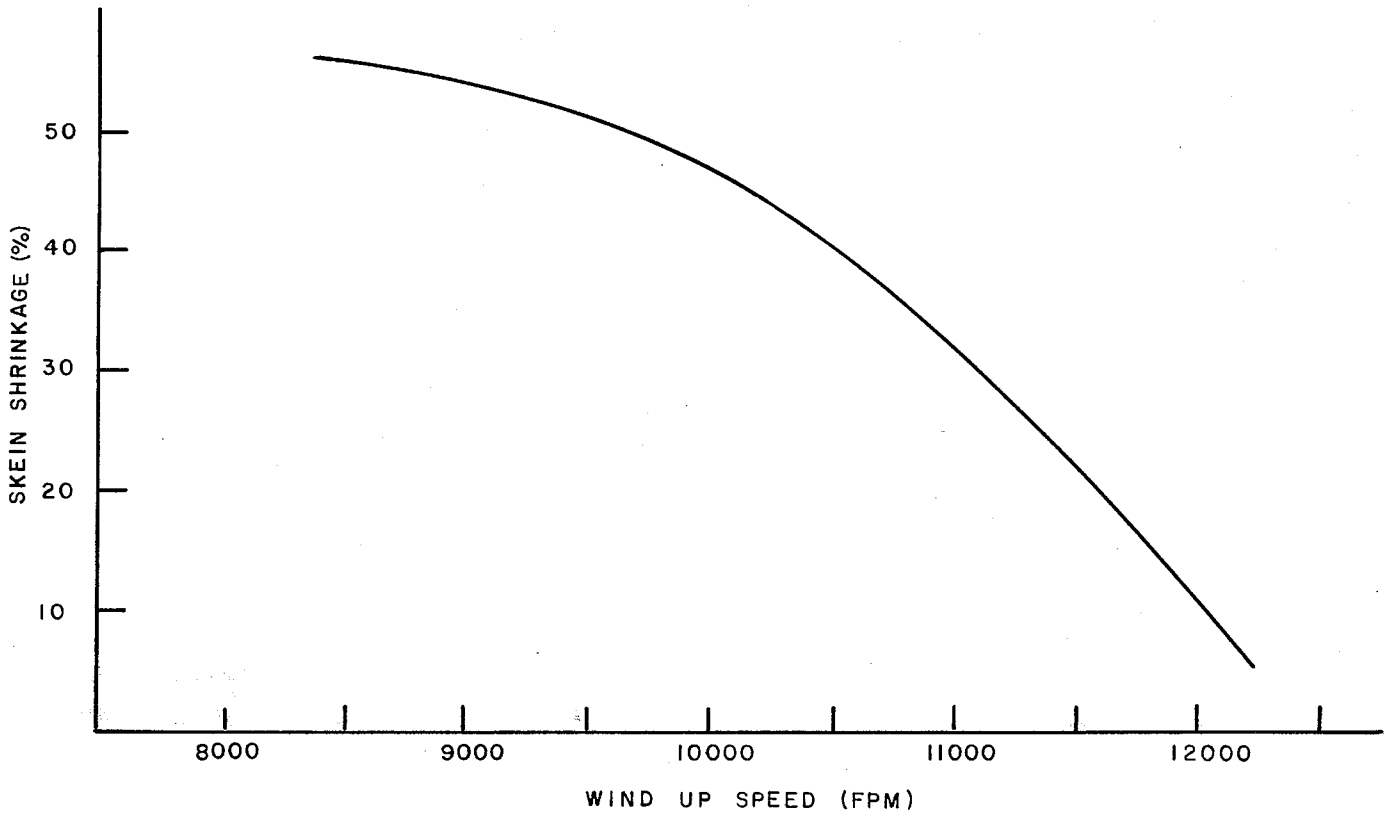
FIG. 3 is a graph illustrating the effect of windup speed on the skein shrinkage of the resulting yarn.

To further illustrate the effect and breadth of yarn latent bulking properties that can be produced by the B process, a series of single component yarns were produced without heat treatment at wind-up speeds ranging from 8,300 to 12,000 feet per minute. Skein shrinkages were then determined for each of the yarns in the series and the shrinkages plotted in FIG. 3. In the B process, the heat treated component of the yarn will have fully drawn yarn properties independent of the wind-up speed and thus a low constant shrinkage of about 6 percent. Thus, a wide variation in bulk level can be achieved based on wind-up speed.

EXAMPLE 8

Process C of the present invention has productivity advantages over the other two processes because it operated at wind-up speeds equal to or greater than 12,000 feet per minute using the spinning configuration of FIG. 2. Contrary to process B, the filaments subjected to an in-column heat treatment become the filaments which provide the high shrinkage fraction of the yarn, whereas the untreated filaments produce the low shrinkage fraction of the yarn. The heat treatment, however, utilizes lower temperatures than the B process with the consequent theorization that the lower heat treatment, being above the second order transition temperature but less than 150 degrees centigrade, induces draw-down in the hot air tube, thereby increasing the amorphous orientation without providing sufficient time and temperature to provide full crystallization. Thus, at the high spinning speed, the untreated yarn results in a highly oriented yarn having a boiling water shrinkage of 10 percent or less whereas the intermediate temperature treatment of a portion of the filament results in a higher shrinkage up to 60 percent.

In accordance with FIG. 2, polyethylene terephthalate having an intrinsic viscosity of 0.682 was melt spun at 300 degrees centigrade using a 20 hole spinneret to produce 42 denier, 20 filament yarn. The molten filaments were directed downwardly into a spinning column and cooled by passing them through a cross-flow quench zone. As the filaments passed through the quench zone, they were divided into two groups of 10 filaments each prior to reaching a hot air tube.

A single hot air tube was positioned approximately 4 feet from the spinneret face and measured $\frac{5}{8}$ inch inside diameter by 1 meter in length. One group of the filaments passed through the hot air tube and the other filaments continued downwardly through the spinning column without treatment. The hot air tube was set at a temperature of 145 degrees centigrade. The filaments exiting from the hot air tube and the untreated filaments had a spin finish applied thereto prior to converging the filaments into a singles yarn before reaching a first godet at the bottom of the spinning column. The converged yarn was then passed through an interlacing jet positioned prior to a second godet to provide yarn integrity prior to being taken up on a package at a speed of 14,000 feet per minute.

Yarns produced in this manner had a shrinkage of 11.2 to 15.8 percent, a tenacity of 3.38 gpd and an elongation of 48.2 percent.

By reducing the hot air tube temperature to as low as 80 degrees centigrade, higher shrinkage yarns are produced. In the same manner, increased spinning speeds up to the limit of the winders can be utilized to produce the latent bulk yarns of this process.

Fabrics were produced using the yarns of this example prior to subjecting them to bulk development. Jersey and Delaware knitting stitches were used to form these fabrics. After forming the fabrics, they were subjected to controlled shrinkage and dyed followed by dimension controlled heat setting to provide for shrinkage and bulk development. The resulting fabrics had a very soft hand with silk-like ascetics and sheen. The measured fabric bulk was proportional to the skein shrinkage.

While the invention has been described with reference to certain preferred embodiments, it is recognized that various changes therein can be made as will be readily apparent to those skilled in the art without departing from the spirit and scope of the invention. Consequently, it is intended that the invention be claimed broadly, being limited only by the appended claims.

What is claimed is:

1. A process for producing a latent heat bulkable polyethylene terephthalate yarn comprising melt spinning a polyethylene terephthalate fiber-forming polymer into a plurality of filaments, cooling the melt-spun filaments below the second order transition temperature, dividing the filaments into at least two groups, subjecting at least one group of filaments to a heat treatment at a temperature above the second order transition temperature, recombining the filaments into a yarn and taking up the yarn at a speed in excess of 8000 feet per minute and subsequently subjecting the yarn to a heat treatment at a temperature of 100 to 225 degrees centigrade in a relaxed state to differentially shrink said yarn and develop bulk.

2. The process of claim 1 wherein the yarn is intermingled after recombining prior to take-up.

3. The process of claim 1 wherein two groups of filaments are subjected to a heat treatment at temperatures above the second order transition temperature but below the melting point wherein a temperature treatment differential is maintained between the two groups of filaments of at least 40 degrees centigrade.

4. The process of claim 3 wherein the take-up speed is in the range of 11,000 to 20,000 feet per minute.

5. The process of claim 3 wherein one group of filaments is heat treated at a temperature of 80 to 150 degrees centigrade and the other group of filaments is heat treated at a temperature of 150 to 250 degrees centigrade.

6. The process of claim 1 wherein the filaments are separated into two groups and one group is heat treated by subjecting to a temperature from above the second order transition temperature up to just below the melting temperature, and the yarn is taken up at a speed of 9000 to 12,000 feet per minute.

7. The process of claim 6 wherein the remaining filaments are not subjected to heat treatment prior to take-up.

8. The process of claim 1 wherein each group of filaments represent 25 to 75 percent of the number of filaments in the yarn.

9. The process of claim 8 wherein two groups of about equal numbers of filaments make up the yarn.

10. The process of claim 1 wherein only one of the groups of filaments is subjected to a temperature above the second order transition temperature and the yarn is taken up at a speed in excess of 12,000 feet per minute.

11. The process of claim 10 wherein one group of filaments is subjected to a heat treatment at a temperature of 80 to 150 degrees centigrade and the remaining filaments are not heat treated, the filaments recombined into a yarn and taken up at speeds of 12,000 to 20,000 feet per minute.

12. The process of claim 1 wherein the yarn is formed into fabric prior to developing said bulk.

13. A latent heat bulked yarn comprising a plurality of polyethylene terephthalate flat filaments intimately mixed together, said filaments representing at least two different groups, each group of which having different physical characteristics, one group thereof having characteristics cf high birefringence, high crystalline orientation, elongation of less than 50 percent and boiling water shrinkage of less than 10 percent, another group thereof having substantial as-spun orientation and characteristic high birefringence but less than fully drawn, an elongation of 50 to 150 percent and boiling water shrinkage of 10 to 60 percent said yarn having been bulked by subjecting the same to heat bulking temperatures of 100 to 225 degrees Centigrade.

14. The yarn of claim 13 wherein the yarn contains two groups of filaments, each group representing 25 to 75 percent of the number of filaments in the yarn.

15. The yarn of claim 14 wherein the number of filaments in each group is about equal.

* * * * *

UNITED STATES PATENT OFFICE

CERTIFICATE OF CORRECTION

Patent No. 4,246,747 Dated January 27, 1981

Inventor(s) Joseph A. Plunkett, James R. Talbot

It is certified that error appears in the above-identified patent and that said Letters Patent are hereby corrected as shown below:

On the title page, Item [56] after References Cited add:

| | | | |
|---|---|---|---|
| 3,199,281 | 8/1965 | Maerov et al | 57/245 |
| 2,980,492 | 4/1961 | Jamieson et al | 57/905 XR |
| 3,444,681 | 5/1969 | Reese | 57/351 XR |
| 3,608,296 | 9/1971 | Taylor | 57/244 XR |

Signed and Sealed this

*Twenty-ninth* Day of *June 1982*

[SEAL]

*Attest:*

GERALD J. MOSSINGHOFF

*Attesting Officer*

*Commissioner of Patents and Trademarks*